US006184617B1

(12) United States Patent
Choi

(10) Patent No.: US 6,184,617 B1
(45) Date of Patent: Feb. 6, 2001

(54) ELECTRON GUNS FOR PRECLUDING DISTORTION OF BEAM SPOTS

(75) Inventor: Jin Yeol Choi, Daeku (KR)

(73) Assignee: Goldstar Co., Ltd., Seoul (KR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/359,551

(22) Filed: Dec. 19, 1994

(30) Foreign Application Priority Data

Aug. 13, 1994 (KR) ..... 94-20031

(51) Int. Cl.[7] ..... H01J 29/46
(52) U.S. Cl. ..... 313/447; 313/449
(58) Field of Search ..... 313/447, 449, 313/409, 410, 411, 412, 413, 414, 441

(56) References Cited

U.S. PATENT DOCUMENTS

| | | | | |
|---|---|---|---|---|
| 4,877,998 | * | 10/1989 | Maninger et al. | 315/15 |
| 5,034,653 | * | 7/1991 | Cho et al. | 313/414 |
| 5,404,071 | * | 4/1995 | Son | 313/414 |
| 5,418,421 | * | 5/1995 | Hasegawa et al. | 313/412 |
| 5,430,349 | * | 7/1995 | New et al. | 313/412 |
| 5,449,983 | * | 9/1995 | Sugawara et al. | 315/382 |
| 5,451,834 | * | 9/1995 | Dho et al. | 313/414 |

* cited by examiner

*Primary Examiner*—Michael H. Day

(57) ABSTRACT

An electron gun for a color cathode ray tube contains a cathode, first grid, second grid and third grids, sequentially disposed between the cathode and a screen, and wherein the vertical length of electron beam passing hole formed on the first and third grids is longer than the horizontal length thereof and the vertical length of an electron beam passing hole formed on the second grid is shorter than the horizontal length thereof.

5 Claims, 7 Drawing Sheets

ELECTRON GUNS FOR PRECLUDING DISTORTION OF BEAM SPOTS

BACKGROUND OF THE INVENTION

The present invention relates to an electron gun for a color television receiver, and more particularly, to an electron gun for precluding the distortion of beam spots on the periphery of a screen.

General electron guns are shown in FIG. 1. An electron beam forming region (BFR) is depicted at the left side of the drawing. The BFR is composed of a cathode 1 for emitting thermions according to input electrical signals of red, green and blue, a first grid electrode 2 installed on one side of the cathode and for controlling electron beams emitted from the cathode, and a second grid electrode 3 installed on one side of the first grid electrode and for attracting and accelerating the thermions gathered on the surface of the cathode. A main focusing lens for forming electron beam spots by focusing thin the electron beams serially incident from the BFR is formed on one side of the second grid electrode. The main focusing lens contains a first accelerating/focusing electrode 4 and second accelerating/focusing electrode 5 are disposed in line. On the second accelerating/focusing electrode 5, a shield electrode (not shown) is fixed to shield and alleviate the leakage from the magnetic field of a deflection yoke.

Among various electron guns is a multilevel focusing type for reinforce the focusing effect. As shown in FIG. 2, this multi-level focusing type forms a front focusing lens-system which further comprises third and fourth grid electrodes 6 and 7 for front focusing, between the BFR and the electrodes of the main focusing lens.

The electrodes on which three electron beam passing holes are made to pass the red, green and blue electron beams produced from cathode 1 are fixed and integrated with a pair of bead glasses, while being spaced apart by a predetermined interval.

In the conventional electron gun, as cathode 1 is heated by a heater, thermions are emitted and thus electron beams are formed. The electron beams are controlled by first grid electrode 2 and accelerated by second grid electrode 3. The electron beams pass through first accelerating/focusing electrode 4 and second accelerating/focusing electrode 5, both of which are included in the main lens, so that they are focused thin and accelerated by the difference between the voltages applied to first accelerating/focusing electrode 4 and second accelerating/focusing electrode 5. The focused thin and accelerated electron beams activate a phosphor coated on the inner surface of a panel, forming an image on the screen.

In these conventional electron guns, the electron beam passing holes are formed in almost full circle from the first grid electrode 2 to the second accelerating/focusing electrode 5. The main focusing lens formed by the first and second accelerating/focusing electrodes 4 and 5 is a circle-axis symmetric lens. When a voltage necessary in the operation of the electron guns is applied, the electron beams passing through the electron beam passing holes are focused rotation-symmetrically according to the Lagrange's reflection law so that the electron beams leave from the electron guns. The electron beams are focused thin without being deformed until they arrive near the screen which is not affected by the effect of the deflection yoke, so that small spots of electron beam are formed on the screen.

The reproduction of image is performed so that the electron beams emitted from the electron guns are projected throughout the screen by the deflection magnetic field. The deflection magnetic field of the deflection yoke deflects the electron beams throughout the screen and also converges the plurality of electron beams at one point of the screen. For this purpose, the electron beams are emitted in lateral (X-X) in-line and the deflection magnetic field produced from the deflection yoke is established as nonuniform. It is noted that in the nonuniform magnetic field, the center portion and the edges (the periphery of screen) are different in intensity. A self convergence mode uses the nonuniform magnetic field. The electron beams of red, green and blue are automatically focused on the overall surface of screen by the magnetic field of the self convergence mode. The magnetic field of self convergence mode is divided into a pincushion magnetic field which is the lateral (X-X) deflection magnetic field as shown in FIG. 3A, and a barrel magnetic field which is the vertical (X-Y) deflection magnetic field as shown in FIG. 3B.

They are dipole or quadrupole as shown in FIG. 4. As shown in FIGS. 4A and 4B, after being emitted from the electron guns, the electron beams are mainly deflected in the arrow direction by the dipole and receive a magnetic force microscopically in the arrow direction by the quadrupole. Here, the electron beams are rendered as in FIG. 4C so that they are affected by a diffusion magnetic field lens laterally and by a focusing magnetic field lens vertically.

The electron beams emitted from cathode 1 are focused serially by the cathode lens, prefocus lens and main lens vertically and laterally so that they form almost circular electron beam spots at the center of the screen because vertical (Y-Y) and lateral (X-X) focusing actions are the same at the center of the screen.

However, on the periphery (edges) of screen influenced by the deflection magnetic field, the electron beams are strongly focused by the vertical (Y-Y) focusing magnetic field lens vertically so that they are over-focused. The electron beams are diverged laterally by the lateral (X-X) diffusion magnetic field lens so that they are under-focused. This results in decreasing resolution.

In order to improve the deterioration of resolution on the periphery of screen by the deflection magnetic field as described above, there has been suggested a method in which the vertical (Y-Y) and lateral (X-X) diffusion actions of electron beam by the prefocus lens are varied to differentiate the incident angle of electron beam vertically and laterally at the main focusing lens.

In this method, since the electron beams pass through the main focusing lens with the incident lens being varied by the prefocus lens, the vertical and lateral tracks of the electron beams having passed through the main focusing lens are varied to compensate for the passage of electron beam varied when passed the focusing magnetic field lens and diffusion magnetic field lens. This prevents the resolution at the periphery of screen from being lowered.

In this structure, the electron beams are strongly focused vertically (Y-Y) by the nonuniform deflection magnetic field and therefore tended to be horizontally elongated. This is because the intensity of the nonuniform magnetic field becomes stronger toward the periphery (edges) of screen.

Since the difference of distance from the focal tracks of the electron beams to the screen becomes greater toward the periphery (edges) of screen, core portion 9 of electron beam spot 8 becomes slender at the periphery of screen and halo portion 10 thereof having a low density of electrons becomes fat, as shown in FIG. 5A. This greatly deteriorates the resolution of color cathode ray tube.

In order to eliminate horizontally elongated core portion 9 and halo portion 10 of a low electron density and created above and under the core portion, there has been suggested a method in which the prefocus portion is made as a non-axis symmetric prefocus lens so that the electron beams are previously elongated vertically prior to the incidence on the main focusing lens (between reference numerals 3 and 4) as shown in FIG. 2. In addition, in order to vertically elongate the electron beams incident on the deflection area after passing through the circle-axis symmetric lens of the main focusing lens, there has been proposed a method of forming a horizontally elongated electron beam passing hole 3*a* on second grid electrode 3. However, with these methods, the halo portions corresponding to the difference of distance from the focal tracks to the screen cannot be completely removed at the periphery of screen so that electron beam spots 8*a* are vertically elongated on the center of screen.

FIG. 5A shows the shape of electron beam spot 8 at respective positions of screen with electron guns having circle-axis symmetric electron beam passing holes. In FIG. 5A, it is noted that on the center of screen, the spots are formed in a circular core, and that at the periphery of screen, the core portion 9 is slender and halo portion 10 is widened up and down. In FIG. 5B, horizontally elongated electron beam passing holes 3*a* are formed on the BFR. It is noted that at the periphery of screen, the halo 10 of electron beam spot 8*a* is removed a little but not completely. This phenomenon becomes more serious as the deflection angle of electron beam becomes greater and a color cathode ray tube becomes larger.

SUMMARY OF THE INVENTION

Therefore, it is an object of the present invention to provide a electron gun for improving the electron beam characteristic at the center and periphery of a screen so that beam spots are uniform throughout the screen.

To accomplish the object of the present invention, there is provided a electron gun for a color cathode ray tube in which a cathode, first grid, second grid and second grid are sequentially disposed, and wherein the vertical length of an electron beam passing hole formed on the first and second grids is longer than the horizontal length thereof and the vertical length of an electron beam passing hole formed on the second grid is shorter than the horizontal length.

DETAILED DESCRIPTION OF THE INVENTION

Hereinafter, the preferred embodiments of the present invention will be described with reference to FIGS. 6–10.

Figure 1:
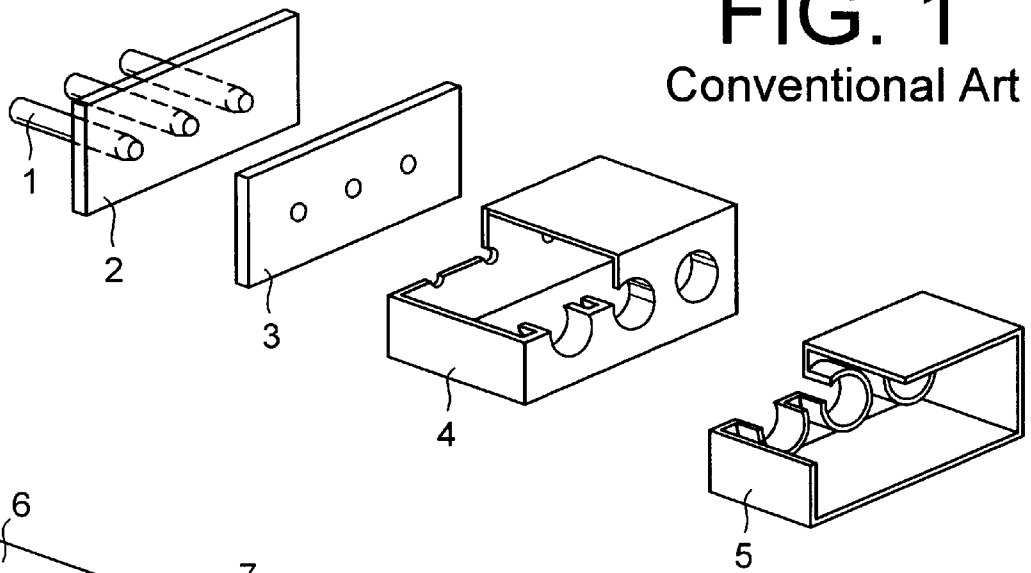
FIG. 1 Conventional Art
FIG. 1 is a cutaway perspective view of conventional single-main-lens electron guns.
Figure 2:
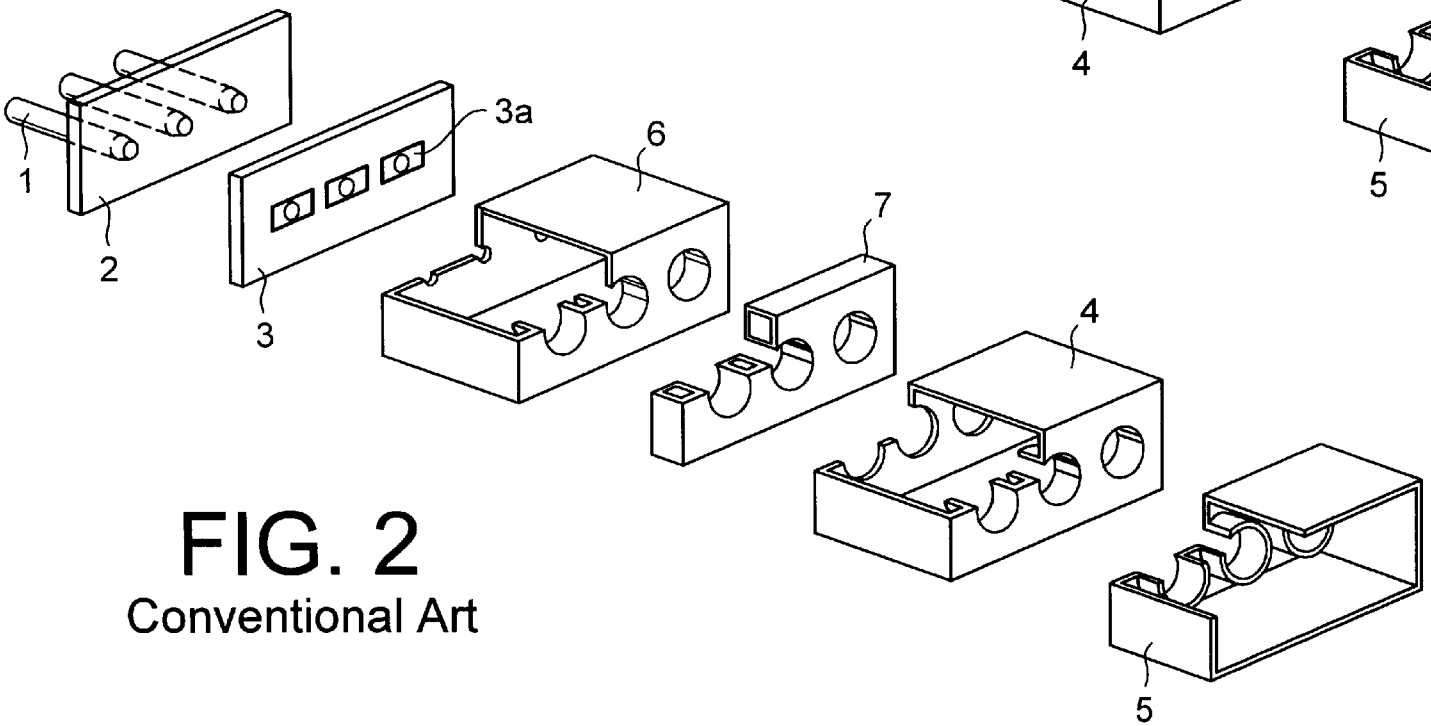
FIG. 2 Conventional Art
FIG. 2 is a perspective view of electron guns having a front focusing lens in the structure of FIG. 1.
Figure 3A:
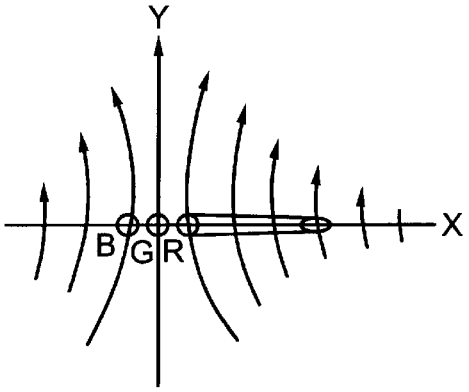
FIG. 3A Conventional Art
FIG. 3A illustrates the relationship between the electron beam spots of conventional electron guns and a pincushion magnetic field.
Figure 3B:
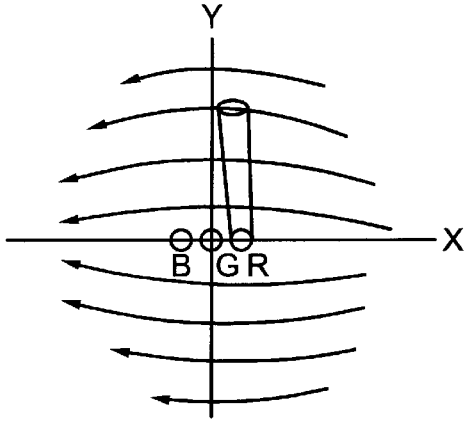
FIG. 3B Conventional Art
FIG. 3B illustrates the relationship between the electron beam spots of conventional electron guns and a barrel magnetic field.
Figure 4A:
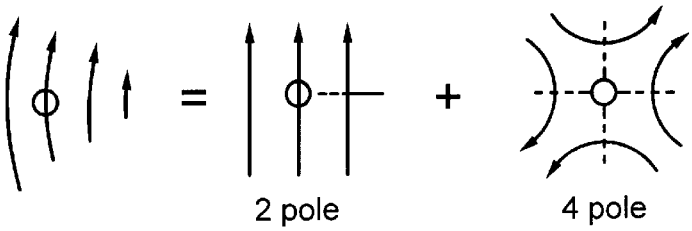
FIG. 4A Conventional Art
FIGS. 4A, 4B and 4C illustrate the states in which an electron beam is affected by a magnetic field.
Figure 4B:
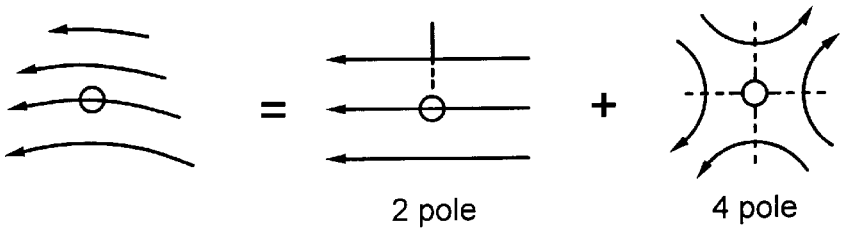
FIG. 4B Conventional Art
Figure 4C:
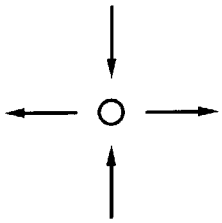
FIG. 4C Conventional Art
Figure 5A:
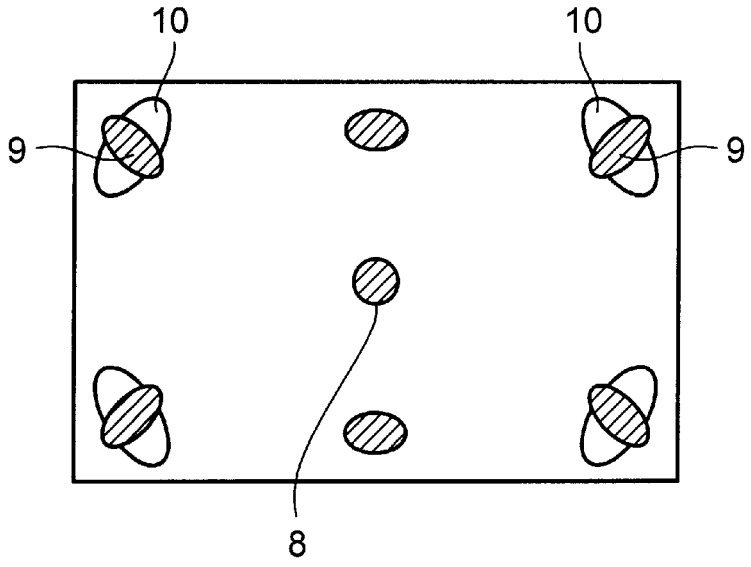
FIG. 5A Conventional Art
FIGS. 5A and 5B illustrate the shapes of electron beam spot at respective position of a screen.
Figure 5B:
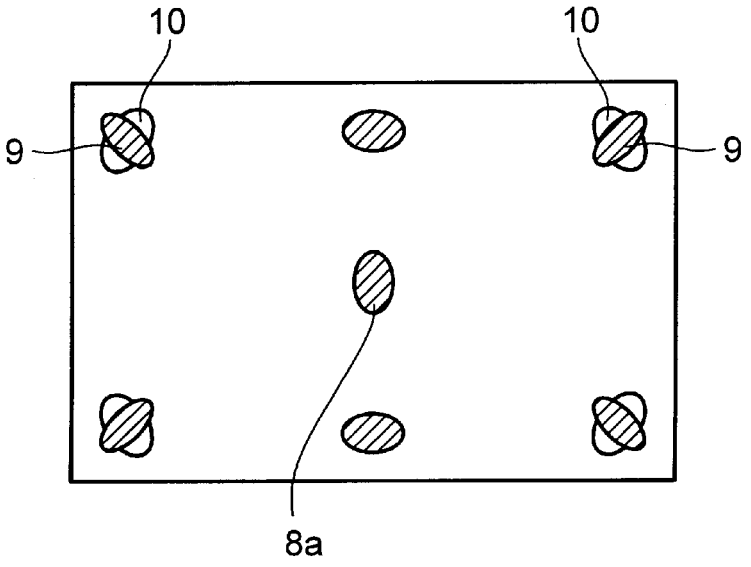
FIG. 5B Conventional Art
Figure 6:
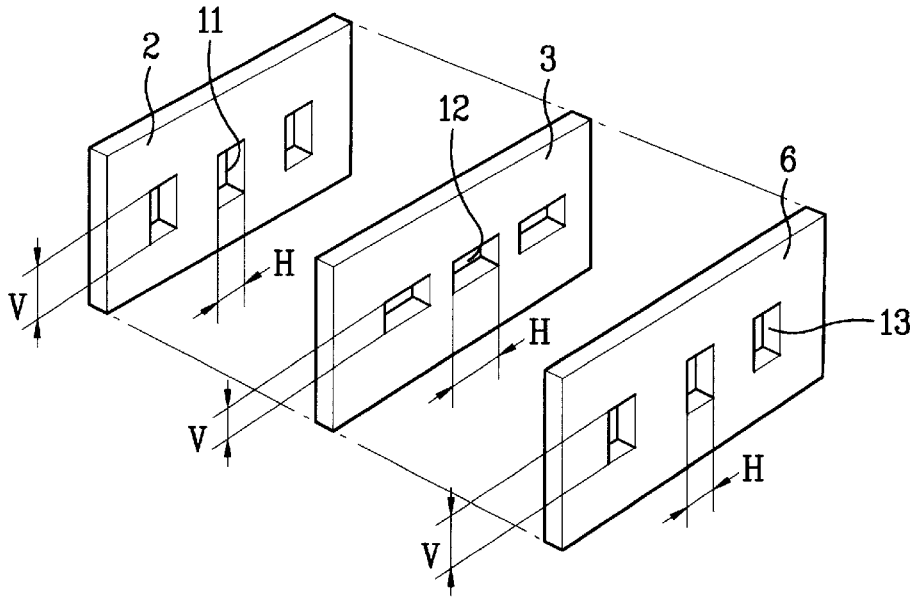
FIG. 6 is a perspective view of one embodiment of the present invention.

Referring to FIG. 6, a first grid 2, a second grid 3 and a third grid 6 are installed sequentially from cathode 1 to a screen. On the first and third grids 2 and 6, electron beam passing holes 11 and 13 in which the vertical length V is longer than the horizontal length H, are formed. On the second grid 3, electron beam passing holes 12 in which the vertical length V is shorter than the horizontal length H, are formed. It is preferable that the shapes of electron beam passing holes 11, 12 and 13 are rectangular. The vertical length V of electron beam passing holes 11 formed on first grid 2 is preferably 1.1–1.4 times the horizontal length H.

Such a configuration of the present invention is improved to minimize the distortion of electron beam when the electron beams are deflected toward the periphery of the screen. The electron beams are vertically elongated when incident on the main lens (refer to FIG. 8) so that the vertical deflection aberration is minimized. This enhances resolution by removing the halo at the periphery of screen.

Figure 7A:
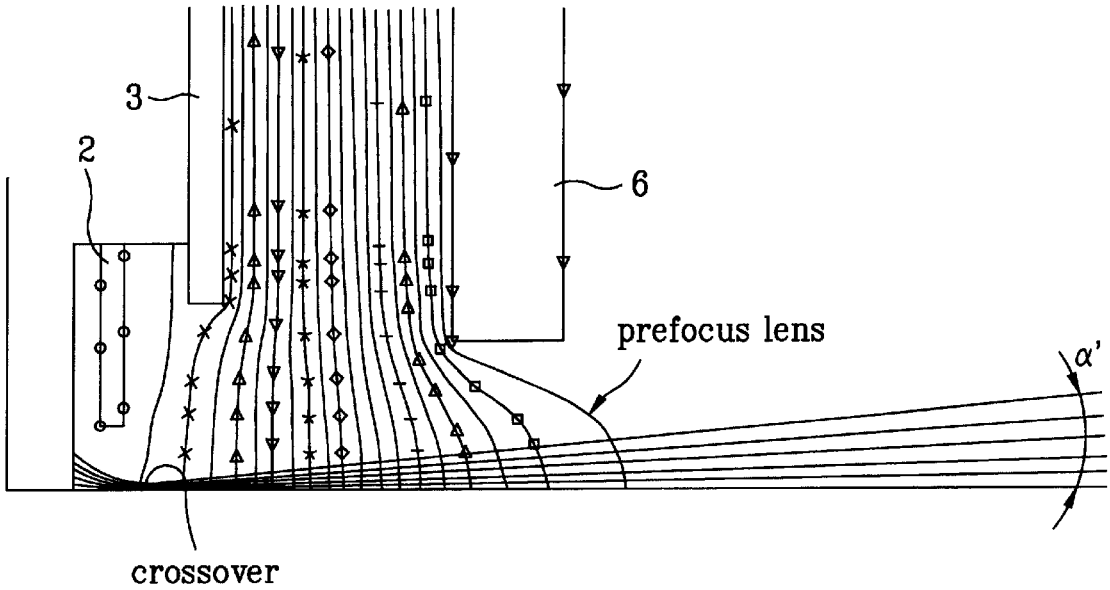
FIGS. 7A and 7B illustrate the focusing of an electron beam vertically and laterally according to the present invention.
Figure 7B:
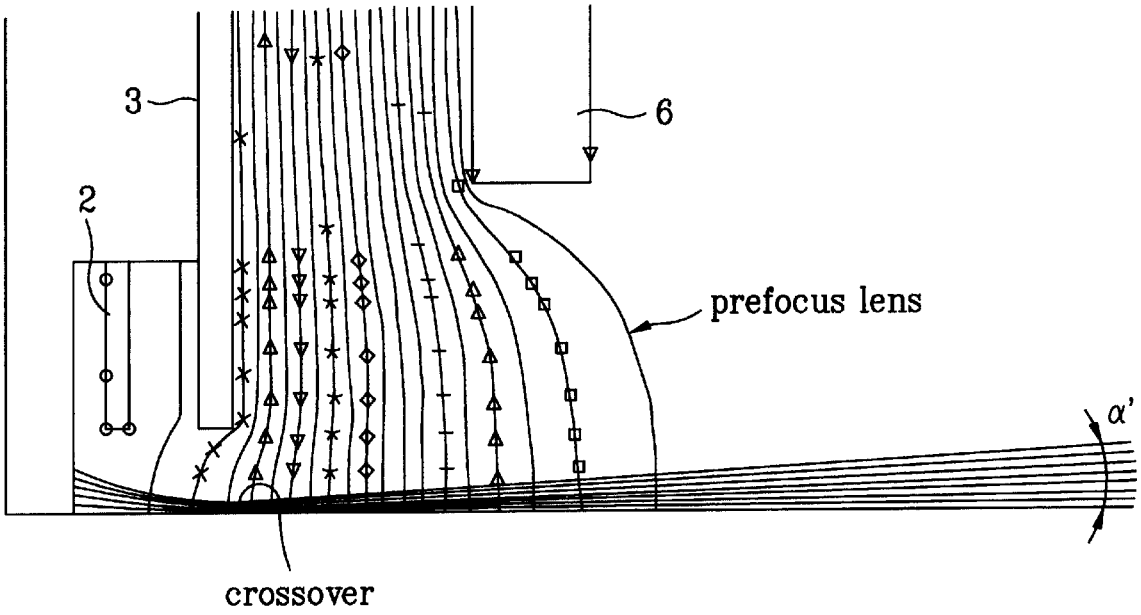
Figure 8:
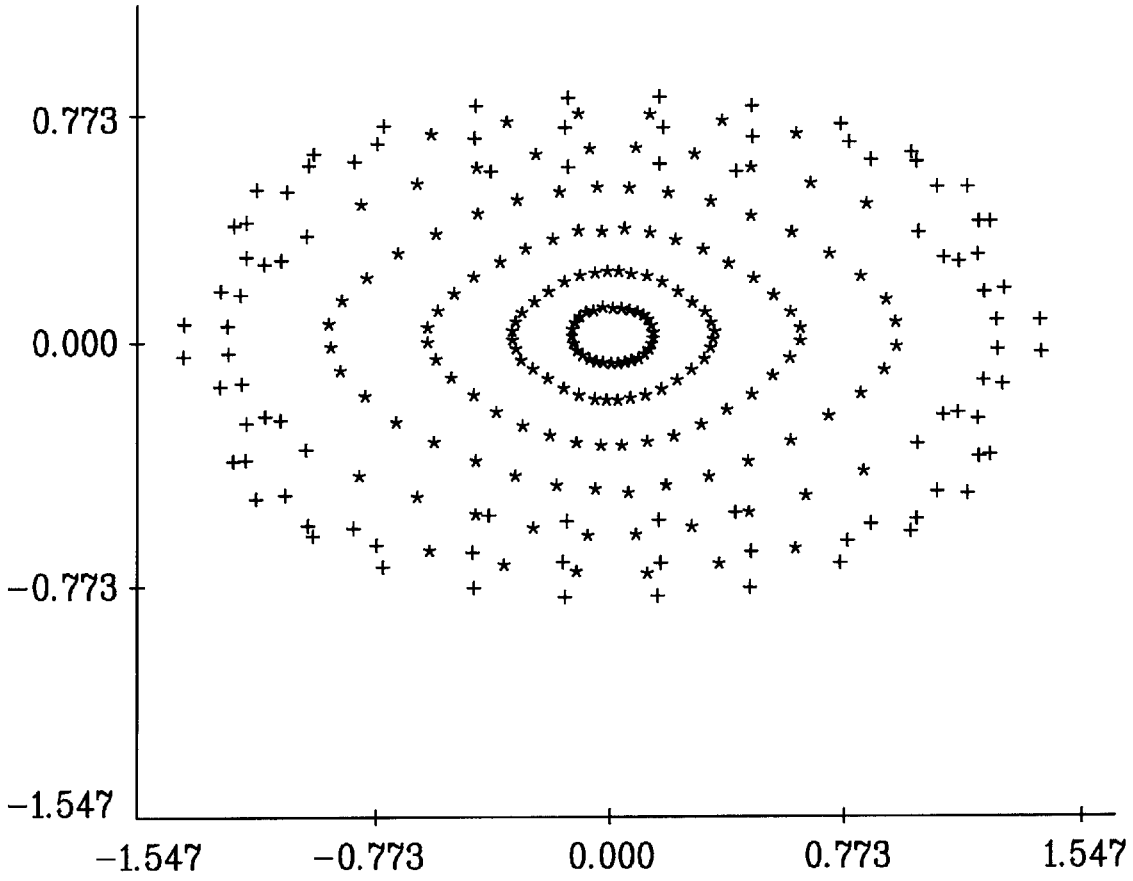
FIG. 8 is a graph showing the shape of an electron beam according to the present invention.
Figure 9:
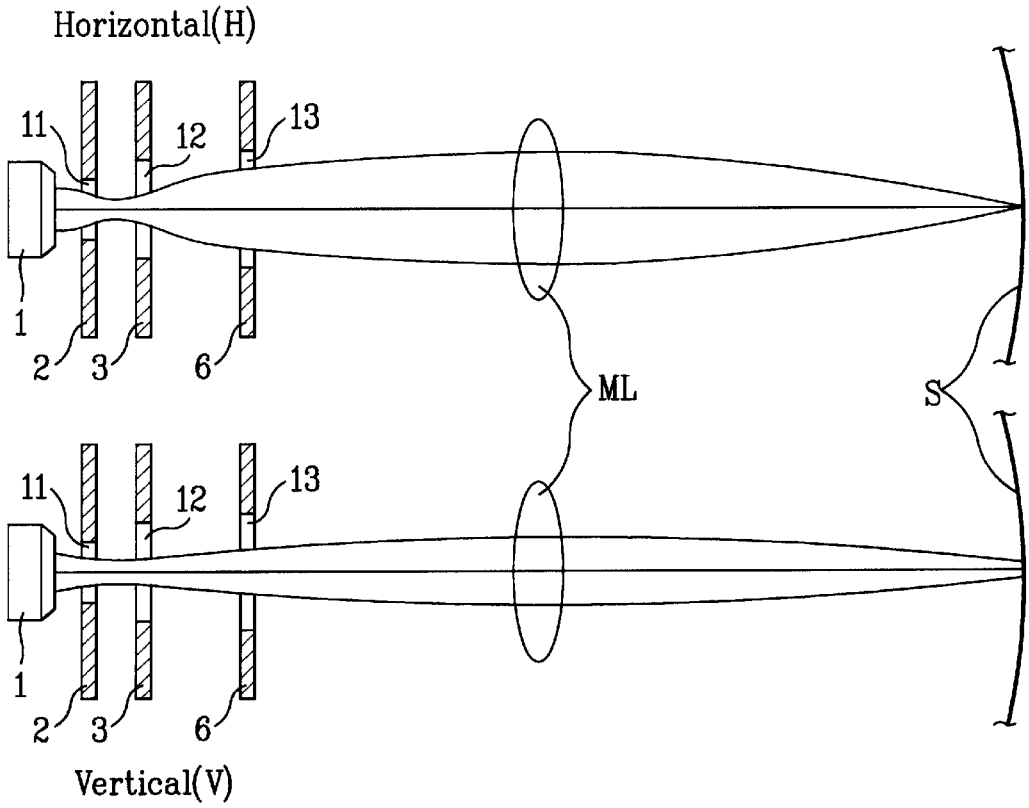
FIG. 9 is an optical diagram for explaining the deformation of electron beams by the electron guns of the present invention.

The-principle of forming the horizontally elongated electron beams of the present invention will be described with reference to FIGS. 7A and 7B. As shown in the drawings, the vertical and horizontal focusing actions of electron lens are varied according to the shapes of electron beam passing holes. In the vertical direction (in FIG. 7B), since electron beam passing holes 11 of first grid 2 are large, crossover is formed farther away from the plane of cathode 1 so that the divergence angle $\alpha'$ of electron beam is reduced. In addition, according to the shapes of second and third grids 3 and 6, the focusing action of the prefocus lens is reinforced so that the electron beam prior to passing through the main lens is horizontally elongated as shown in FIG. 8.

This horizontally elongated electron beam passes through the main lens ML so that the focal track is elongated more vertically than horizontally to compensate for the shortening of the vertical focal track at the periphery of screen. Therefore, the electron beam forms a vertically elongated beam spot on screen S.

The horizontally elongated electron beam exhibits a good characteristic when the first grid is H<V, the second grid is H>V, and the third grid is H<V. It is preferable that the vertical length V of electron beam passing hole formed on first grid 2 should be 1.1–1.4 times of the vertical length H in consideration of the emission area of electron beam.

Figure 10:
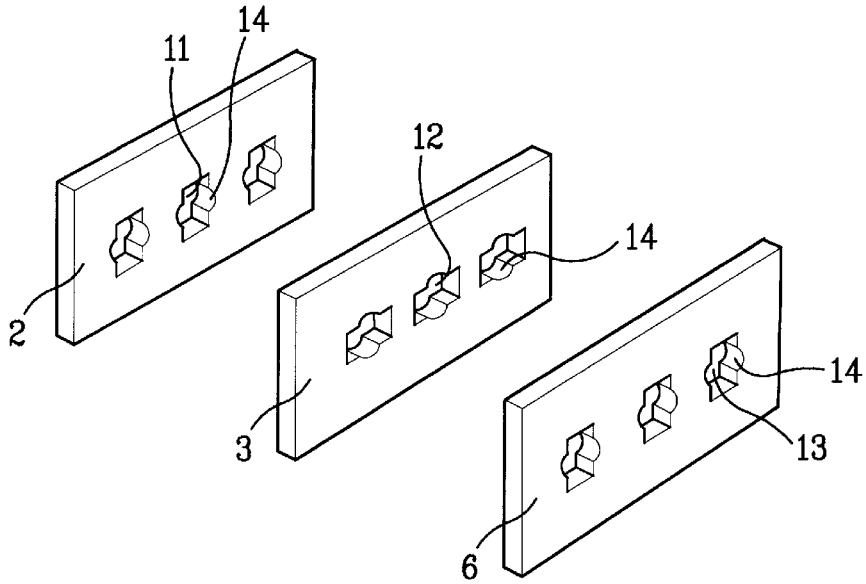
FIG. 10 illustrates another embodiment of the present invention.

Referring to FIG. 10, in order to facilitate the alignment in assembly, a circular recess 14 is formed at the edges of rectangular electron beam passing holes so that the respective grids are inserted into zig by using the recesses.

As described above, in this invention, the rectangular electron beam passing holes are formed on the first, second and third grids, thereby cancelling the distortion due to the deflection aberration of the electron beam. At the center and periphery of screen, the beam spot is formed with a core of a high electron density. This accordingly obtains high resolution from the center of screen to the periphery thereof.

What is claimed is:

1. An electron gun for precluding the distortion of beam spot comprising:

a cathode for emitting thermions;

a first controlling electrode grid having an electron beam passing hole in which the vertical length of the electron beam passing hole is longer than the horizontal length and which controls the emitted thermions;

a second accelerating electrode grid having an electron beam passing hole in which the vertical length of the electron beam passing hole is shorter than the horizontal length and which accelerates the thermions; and a third focusing electrode grid having an electron beam passing hole in which the vertical length of the electron beam passing hole is longer than the horizontal length and which focuses the emitted thermions.

2. An electron gun for precluding the distortion of beam spot as claimed in claim 1, wherein the vertical length of said first control electrode grid is 1.1–1.4 times the horizontal length.

3. An electron gun for precluding the distortion of beam spot as claimed in claim 1, wherein the electron beam passing holes formed on said first, second and third electrode grids are rectangular.

4. An electron gun for precluding the distortion of beam spot as claimed in claim 3, wherein a circular recess is formed on the edges of said rectangular electron beam passing holes.

5. An election gun for precluding the distortion of beam spot as claimed in claim 1, wherein said thermions from said cathode pass through said first controlling electrode grid, then through said second accelerating electrode grid and then through said third focusing electrode grid.

* * * * *